US012203240B2

(12) United States Patent
Indoh

(10) Patent No.: US 12,203,240 B2
(45) Date of Patent: Jan. 21, 2025

(54) CONSTRUCTION MACHINE, DISPLAY APPARATUS OF CONSTRUCTION MACHINE, AND MANAGEMENT APPARATUS OF CONSTRUCTION MACHINE

(71) Applicant: SUMITOMO HEAVY INDUSTRIES, LTD., Tokyo (JP)

(72) Inventor: Masahito Indoh, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 277 days.

(21) Appl. No.: 17/649,827

(22) Filed: Feb. 3, 2022

(65) Prior Publication Data

US 2022/0154424 A1 May 19, 2022

Related U.S. Application Data

(63) Continuation of application No. PCT/JP2020/029898, filed on Aug. 4, 2020.

(30) Foreign Application Priority Data

Aug. 5, 2019 (JP) ..... 2019-143629

(51) Int. Cl.
*E02F 9/20* (2006.01)
*E02F 9/26* (2006.01)

(52) U.S. Cl.
CPC ..... *E02F 9/2025* (2013.01); *E02F 9/26* (2013.01)

(58) Field of Classification Search
CPC . E02F 9/2025; E02F 9/26; E02F 3/435; E02F 9/2235; E02F 9/267; E02F 9/20; E02F 9/205; E02F 9/2054; E02F 9/264; E02F 9/265
See application file for complete search history.

(56) References Cited

U.S. PATENT DOCUMENTS

| | | | | |
|---|---|---|---|---|
| 10,330,523 | B2 * | 6/2019 | Hedin | G01H 1/003 |
| 11,462,058 | B2 * | 10/2022 | Zhang | G07C 5/006 |
| 2003/0110667 | A1 | 6/2003 | Adachi et al. | |
| 2003/0154091 | A1 | 8/2003 | Adachi et al. | |
| 2006/0136110 | A1 | 6/2006 | Casey et al. | |
| 2011/0290024 | A1 * | 12/2011 | Lefler | G01H 1/003 73/579 |

FOREIGN PATENT DOCUMENTS

| | | | |
|---|---|---|---|
| JP | 2011-011622 | | 1/2011 |
| JP | 2011011622 | A * | 1/2011 |
| JP | 2011-038346 | | 2/2011 |
| JP | 2013-224568 | | 10/2013 |
| JP | 2019-032644 | | 2/2019 |

(Continued)

OTHER PUBLICATIONS

International Search Report for PCT/JP2020/029898 mailed on Oct. 27, 2020.

*Primary Examiner* — Khoi H Tran
*Assistant Examiner* — Christopher Scott
(74) *Attorney, Agent, or Firm* — IPUSA, PLLC

(57) ABSTRACT

A construction machine includes a lower traveling body; and a control apparatus configured to determine a traveling vibration of the construction machine at each predetermined timing.

10 Claims, 9 Drawing Sheets

(56) References Cited

FOREIGN PATENT DOCUMENTS

| | | | | |
|---|---|---|---|---|
| JP | 2019-048483 | | | 3/2019 |
| JP | 2019048483 | A | * | 3/2019 |
| JP | 2019157466 | A | * | 9/2019 |
| WO | 2001/073225 | | | 10/2001 |
| WO | 2001/073695 | | | 10/2001 |

* cited by examiner

FIG.5

| OPERATION STATE | WORK SITE A | WORK SITE B |
|---|---|---|
| TRAVELING | 0.2 | 0.1 |
| STOPPED | 0.3 | 0.5 |
| WORKING | 0.5 | 0.6 |

FIG.6A

| VIBRATION INTENSITY LEVEL | 1 | 2 | 3 | 4 | 5 | 6 | 7 | 8 | 9 |
|---|---|---|---|---|---|---|---|---|---|
| COUNT NUMBER | 0 | 0 | 0 | 0 | 0 | 0 | 0 | 0 | 0 |

FIG.6B

| VIBRATION INTENSITY LEVEL | 1 | 2 | 3 | 4 | 5 | 6 | 7 | 8 | 9 |
|---|---|---|---|---|---|---|---|---|---|
| COUNT NUMBER | 0 | 0 | 0 | 1 | 0 | 0 | 0 | 0 | 0 |

FIG.6C

| VIBRATION INTENSITY LEVEL | 1 | 2 | 3 | 4 | 5 | 6 | 7 | 8 | 9 |
|---|---|---|---|---|---|---|---|---|---|
| COUNT NUMBER | 0 | 0 | 0 | 1 | 0 | 0 | 0 | 1 | 0 |

CONSTRUCTION MACHINE, DISPLAY APPARATUS OF CONSTRUCTION MACHINE, AND MANAGEMENT APPARATUS OF CONSTRUCTION MACHINE

CROSS-REFERENCE TO RELATED APPLICATIONS

The present application is a continuation application of International Application No. PCT/JP2020/029898 filed on Aug. 4, 2020, which claims priority to Japanese Patent Application No. 2019-143629, filed on Aug. 5, 2019. The contents of these applications are incorporated herein by reference in their entirety.

BACKGROUND

1. Technical Field

The present invention relates to a construction machine, a display apparatus of a construction machine, and a management apparatus of a construction machine.

2. Description of the Related Art

Conventionally, an excavator that is a construction machine provided with an hour meter for accumulating the operating time, is known. This excavator derives and displays the date on which the excavator is to undergo maintenance, based on the operating time output by the hour meter. Therefore, a manager of a rental business operator or a lease business operator who manages multiple excavators can centrally manage which excavator is to undergo maintenance and when the maintenance is to be performed.

SUMMARY

According to an embodiment of the present invention, there is provided a construction machine including a lower traveling body; and a control apparatus configured to determine a traveling vibration at each predetermined timing.

BRIEF DESCRIPTION OF THE DRAWINGS

FIG. 5 illustrates a table indicating the breakdown of operation states of the excavators;

FIGS. 6A to 6C are conceptual diagrams of a vibration intensity table.

DETAILED DESCRIPTION

In the conventional technology, it is difficult for the manager to accurately identify the degree of wear of an excavator by referring only to the operating time. Thus, there is a risk that inconveniences may occur, such as the inability to properly identify the physical depreciation of the excavator.

Therefore, it is desirable to enable the manager of a construction machine to more accurately identify the degree of wear of the construction machine.

Figure 1:
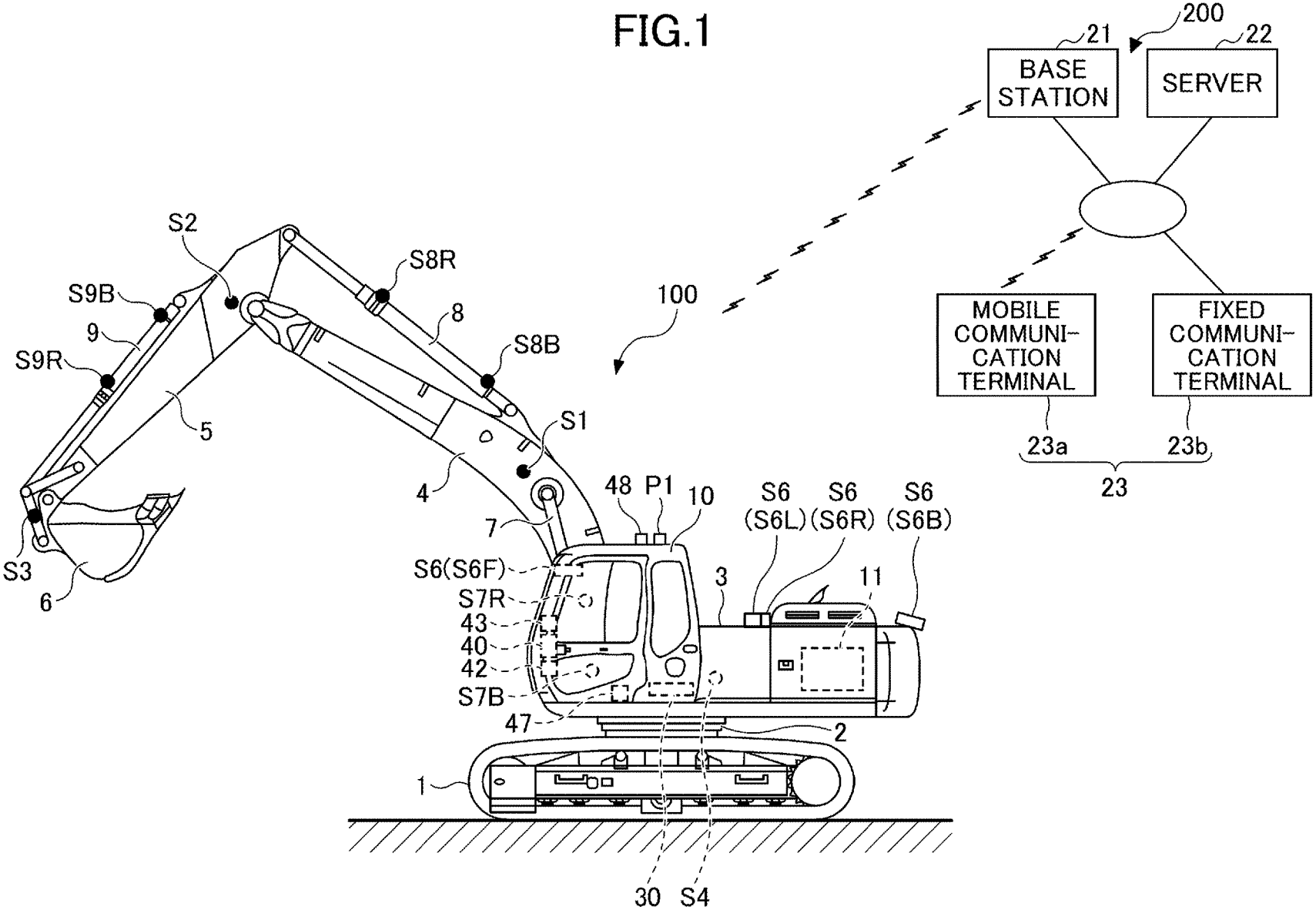
FIG. 1 is a diagram illustrating a configuration example of a communication network to which an excavator according to an embodiment of the present invention is connected.

FIG. 1 is a schematic diagram illustrating a communication network 200 to which an excavator 100 that is an example of a construction machine, according to an embodiment of the present invention, is connected.

On a lower traveling body 1 of the excavator 100, an upper turning body 3 is turnably mounted via a turning mechanism 2. A boom 4 is attached to the upper turning body 3. An arm 5 is attached to the leading end of the boom 4, and a bucket 6 that is an end attachment is attached to the leading end of the arm 5.

The boom 4, the arm 5, and the bucket 6 configure drilling attachments that are examples of attachments. The boom 4 is driven by a boom cylinder 7, the arm 5 is driven by an arm cylinder 8, and the bucket 6 is driven by a bucket cylinder 9. A boom angle sensor S1 is attached to the boom 4, an arm angle sensor S2 is attached to the arm 5, and a bucket angle sensor S3 is attached to the bucket 6. The boom angle sensor S1, the arm angle sensor S2, and the bucket angle sensor S3 are collectively referred to as "posture sensors". These posture sensors are used to determine the posture of the attachment.

As described above, the main body of the excavator 100 is configured by the lower traveling body 1 and the upper turning body 3. An attachment is attached to the main body. Note that construction machines, in which an embodiment of the present invention can be used, include bulldozers, wheel loaders, and the like.

The boom angle sensor S1 is configured to detect the rotation angle of the boom 4. In the present embodiment, the boom angle sensor S1 is an acceleration sensor, and can detect the rotation angle of the boom 4 with respect to the upper turning body 3 (hereinafter, referred to as the "boom angle"). The boom angle is, for example, the minimum angle when the boom 4 is lowest, and increases as the boom 4 is raised.

The arm angle sensor S2 is configured to detect the rotation angle of the arm 5. In the present embodiment, the arm angle sensor S2 is an acceleration sensor, and can detect the rotation angle of the arm 5 with respect to the boom 4 (hereinafter, referred to as the "arm angle"). The arm angle is, for example, the minimum angle when the arm 5 is most closed and increases as the arm 5 is opened.

The bucket angle sensor S3 is configured to detect the rotation angle of the bucket 6. In the present embodiment, the bucket angle sensor S3 is an acceleration sensor, and can detect the rotation angle of the bucket 6 with respect to the arm 5 (hereinafter, referred to as "bucket angle"). The bucket angle is, for example, the minimum angle when the bucket 6 is most closed and increases as the bucket 6 is opened.

The boom angle sensor S1, the arm angle sensor S2, and the bucket angle sensor S3 may each be a potentiometer that uses a variable resistor, a stroke sensor for detecting the stroke amount of a corresponding hydraulic cylinder, a rotary encoder for detecting a rotation angle around a coupling pin, a gyro sensor, an inertial measuring device including a combination of an acceleration sensor and a gyro sensor, or the like.

A boom rod pressure sensor S7R and a boom bottom pressure sensor S7B are attached to the boom cylinder 7. An arm rod pressure sensor S8R and an arm bottom pressure sensor S8B are attached to the arm cylinder 8. A bucket rod pressure sensor S9R and a bucket bottom pressure sensor S9B are attached to the bucket cylinder 9. The boom rod pressure sensor S7R, the boom bottom pressure sensor S7B, the arm rod pressure sensor S8R, the arm bottom pressure sensor S8B, the bucket rod pressure sensor S9R, and the bucket bottom pressure sensor S9B are collectively referred to as "cylinder pressure sensors".

The boom rod pressure sensor S7R detects the pressure in the oil chamber at the rod side of the boom cylinder 7 (hereinafter referred to as "boom rod pressure"), and the boom bottom pressure sensor S7B detects the pressure in the oil chamber at the bottom side of the boom cylinder 7 (hereinafter referred to as "boom bottom pressure"). The arm rod pressure sensor S8R detects the pressure in the oil chamber at the rod side of the arm cylinder 8 (hereinafter referred to as "arm rod pressure"), and the arm bottom pressure sensor S8B detects the pressure in the oil chamber at the bottom side of the arm cylinder 8 (hereinafter referred to as "arm bottom pressure"). The bucket rod pressure sensor S9R detects the pressure in the oil chamber at the rod side of the bucket cylinder (hereinafter referred to as "bucket rod pressure"), and the bucket bottom pressure sensor S9B detects the pressure in the oil chamber at the bottom side of the bucket cylinder 9 (hereinafter referred to as "bucket bottom pressure").

The upper turning body 3 is provided with a cabin 10. The cabin 10 is an operator's cabin where an operator is seated, and is equipped with a power source such as an engine 11. A controller 30, a display apparatus 40, an input device 42, a sound output device 43, a storage device 47, a communication device 48, a positioning device P1, an inertial sensor S4, and an imaging device S6 are attached to the upper turning body 3.

The controller 30 functions as a main control unit for controlling the driving of the excavator 100. In the present embodiment, the controller 30 is configured by a computer including a CPU, a RAM, a ROM, and the like. One or more functions in the controller 30 are implemented, for example, by the CPU executing a program stored in the ROM.

The display apparatus 40 is configured to display various kinds of information. The display apparatus 40 may be connected to the controller 30 via a communication network such as CAN (Controller Area Network) or may be connected to the controller 30 via an exclusive-use line.

The input device 42 is configured to allow an operator to input information to the controller 30. The input device 42 may be, for example, a touch panel, a knob switch, a membrane switch, or the like, provided in the cabin 10.

The sound output device 43 is configured to output sound. The sound output device 43 may be, for example, a speaker connected to the controller 30 or an alarm unit such as a buzzer. In the present embodiment, the sound output device 43 outputs sound information in response to an instruction from the controller 30.

The storage device 47 is configured to store information. The storage device 47 is a non-volatile storage device such as a semiconductor memory. The storage device 47 may store information that is output by one or more devices during the operation of the excavator 100 and may store information acquired or input via one or more devices prior to the start of operation of the excavator 100. The storage device 47 may store, for example, data relating to a target work surface acquired via the communication device 48 or the like. The target work surface may be set by the operator of the excavator 100 or may be set by a work manager or the like.

The positioning device P1 is configured to measure the position of the upper turning body 3. In the present embodiment, the positioning device P1 is a GNSS (Global Navigation Satellite System) compass that detects the position and orientation of the upper turning body 3 and outputs the detected value to the controller 30. Therefore, the positioning device P1 can also function as an orientation detecting device for detecting the orientation of the upper turning body 3. The orientation detecting device may be an orientation sensor attached to the upper turning body 3.

The inertial sensor S4 is configured to measure the motion state of the excavator 100. The inertial sensor S4 is, for example, a 6-axis inertial measurement unit and is configured to measure the angular velocity around the forward-backward axis of the upper turning body 3, the angular velocity around the left-right axis of the upper turning body 3, the angular velocity around the up-down axis of the upper turning body 3, the accelerated velocity in the forward-backward axis direction of the upper turning body 3, the accelerated velocity in the left-right axis direction of the upper turning body 3, and the accelerated velocity in the up-down axis direction of the upper turning body 3. The forward-backward axis and the left-right axis of the upper turning body 3 are orthogonal to each other at the center point of the excavator, which is a point on the turning axis of the excavator 100, for example. However, the inertial sensor S4 may be configured to measure data relating to at least one of the six axes. In the present embodiment, the inertial sensor S4 is configured by a combination of a 3-axis acceleration sensor and a 3-axis gyro sensor.

The inertial sensor S4 may be configured to detect, for example, the tilt of the upper turning body 3 with respect to a predetermined plane, such as a virtual horizontal plane. In the present embodiment, the acceleration sensor configuring the inertial sensor S4 is configured to detect the forward-backward tilt angle (roll angle) around the forward-backward axis of the upper turning body 3 and the right-left tilt angle (pitch angle) around the right-left axis of the upper turning body 3.

The inertial sensor S4 may be configured to detect the turning angular velocity of the upper turning body 3. In the present embodiment, the gyro sensor configuring the inertial sensor S4 is configured to detect the turning angular velocity and the turning angle of the upper turning body 3. In this case, the gyro sensor may be a resolver, a rotary encoder, or the like.

The imaging device S6 is configured to acquire images of the spaces around the excavator 100. In the present embodiment, the imaging device S6 includes a front camera S6F for capturing the space in front of the excavator 100, a left camera S6L for capturing the space on the left side of the excavator 100, a right camera S6R for capturing the space on the right side of the excavator 100, and a rear camera S6B for capturing the space behind the excavator 100.

The imaging device S6 is, for example, a monocular camera including an imaging element such as a CCD or CMOS, and outputs the captured image to the display apparatus 40. The imaging device S6 may be a stereo camera, a distance image camera, or the like.

The front camera S6F is attached, for example, on the ceiling of the cabin 10, i.e., inside the cabin 10. However, the front camera S6F may be attached on the outside of the cabin 10, such as on the roof of the cabin 10 or on the side surface of the boom 4. The left camera S6L is attached to the left end of the upper side of the upper turning body 3, the right camera S6R is attached to the right end of the upper side of the upper turning body 3, and the rear camera S6B is attached to the rear end of the upper side of the upper turning body 3.

The communication device 48 is configured to control communication with an external device that is outside the excavator 100. In the present embodiment, the communication device 48 controls communication with an external device via the communication network 200.

The communication network 200 is primarily configured to interconnect the excavator 100, a base station 21, a server 22, and a communication terminal 23. The communication network 200 includes, for example, at least one of a satellite communication network, a mobile phone communication network, the Internet, or the like.

The communication terminal 23 includes a mobile communication terminal 23*a* and a fixed communication terminal 23*b*. The excavator 100, the base station 21, the server 22, and the communication terminal 23 are connected to each other by using a communication protocol such as, for example, the Internet protocol. The number of each of the excavator 100, the base station 21, the server 22, and the communication terminal 23 connected via the communication network 200, may be one or more. The mobile communication terminal 23*a* may be a notebook PC, a tablet PC, a mobile phone, a smartphone, a smart watch, smart glasses, or the like.

The base station 21 is an external facility that receives information transmitted by the excavator 100. Between the base station 21 and the excavator 100, information is transmitted and received, for example, through at least one of a satellite communication network, a mobile phone communication network, the Internet, or the like.

The server 22 is configured to function as a management apparatus of the excavator 100. In the present embodiment, the server 22 is an apparatus installed in an external facility, such as a management center, and stores and manages information transmitted by the excavator 100. The server 22 is a computer that includes, for example, a CPU, a ROM, a RAM, an input/output (I/O) interface, an input device, a display, and the like. Specifically, through the communication network 200, the server 22 acquires and stores the information received by the base station 21, and manages the information so that the operator (the manager) can refer to the stored information as needed.

The server 22 may be configured to allow an operator (manager) to make one or more settings relating to the excavator 100 through the communication network 200. Specifically, the server 22 may transmit a value relating to one or more settings made by an operator (manager), to the excavator 100, to change the value relating to one or more settings stored in the controller 30.

The server 22 may transmit information relating to the excavator 100 to the communication terminal 23 through the communication network 200. Specifically, the server 22 may transmit information relating to the excavator 100 to the communication terminal 23, when a predetermined condition is satisfied, or upon receiving a request from the communication terminal 23, and transfer the information relating to the excavator 100 to an operator of the communication terminal 23.

The communication terminal 23 functions as a support device of the excavator 100. In the present embodiment, the communication terminal 23 is a device capable of referring to the information stored in the server 22 and is a computer including, for example, a CPU, a ROM, a RAM, an input/output (I/O) interface, an input device, a display, and the like. For example, the communication terminal 23 may be connected to the server 22 through the communication network 200 and may be configured such that information relating to the excavator 100 can be viewed by an operator (a manager). That is, the communication terminal 23 may be configured to receive information relating to the excavator 100 transmitted by the server 22 and allow an operator (a manager) to view the received information.

In the present embodiment, the server 22 manages information relating to the excavator 100 transmitted by the excavator 100. Therefore, the operator (manager) can view the information relating to the excavator 100 at any timing through the display attached to the server 22 or the communication terminal 23.

Figure 2:
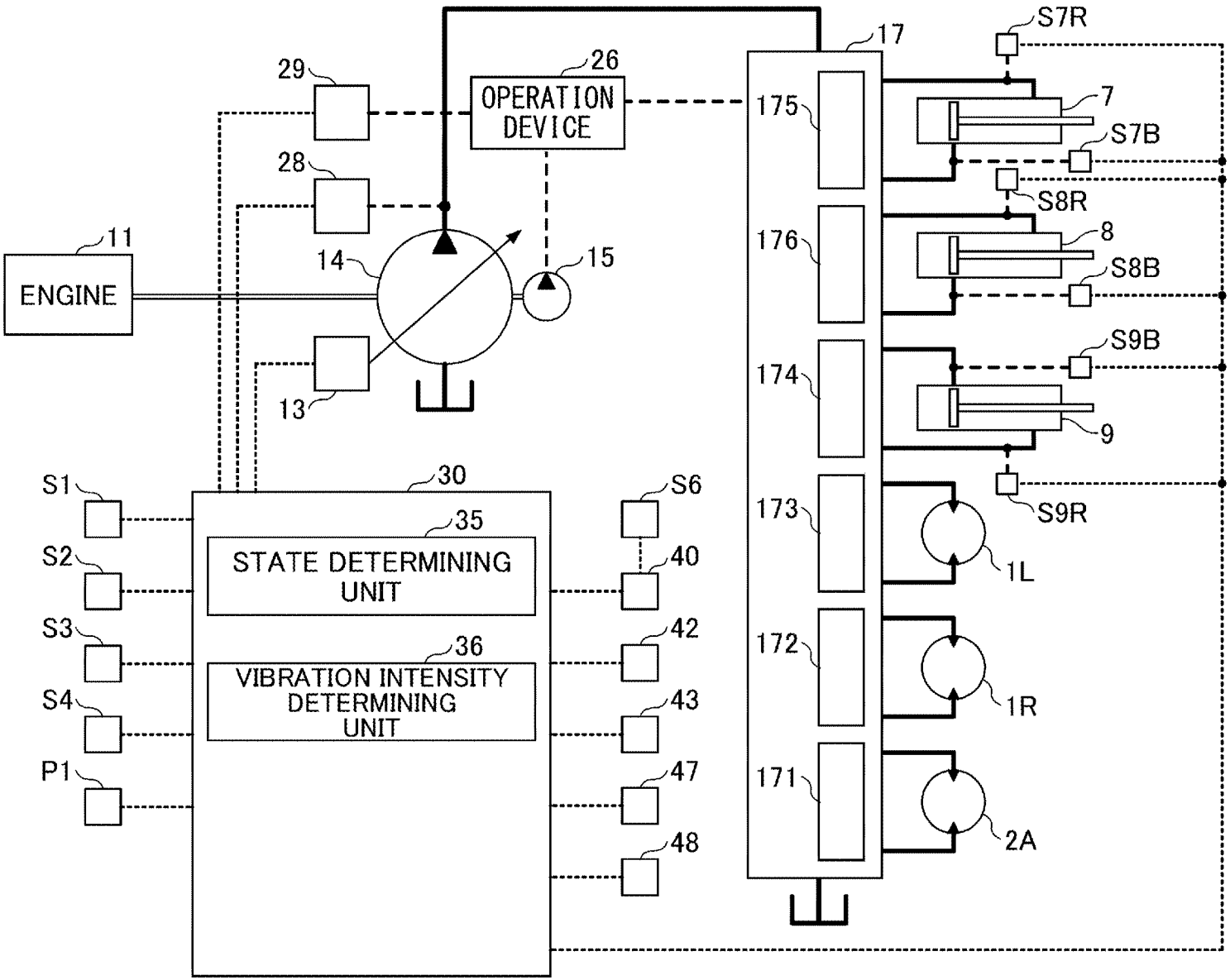
FIG. 2 is a diagram illustrating an example of a configuration of a driving system of the excavator illustrated in FIG. 1.

FIG. 2 is a diagram illustrating an exemplary configuration of the basic system of the excavator 100, illustrating a mechanical power transmission line, a hydraulic oil line, a pilot line, and an electrical control line by double lines, solid lines, dashed lines, and dotted lines, respectively.

The basic system of the excavator 100 primarily includes the engine 11, a regulator 13, a main pump 14, a pilot pump 15, a control valve 17, an operation device 26, a discharge pressure sensor 28, an operation pressure sensor 29, the controller 30, and the like.

The engine 11 is the driving source of the excavator. In the present embodiment, the engine 11 is, for example, a diesel engine that operates to maintain a predetermined revolution speed. The output shaft of the engine 11 is coupled to the respective input shafts of the main pump 14 and the pilot pump 15.

The main pump 14 is configured to supply hydraulic oil to the control valve 17 via a hydraulic oil line. In the present embodiment, the main pump 14 is a swash plate variable capacitive hydraulic pump.

The regulator 13 is configured to control the discharge amount of the main pump 14. In the present embodiment, the regulator 13 controls the discharge amount of the main pump 14 by adjusting the swash plate tilt angle of the main pump 14 in response to an instruction from the controller 30. For example, the controller 30 receives output from the operation pressure sensor 29 or the like, and outputs an instruction to the regulator 13 as needed to change the discharge amount of the main pump 14.

The pilot pump 15 is configured to supply hydraulic oil to one or more hydraulic devices including the operation device 26 via a pilot line. In the present embodiment, the pilot pump 15 is a fixed capacitive hydraulic pump. However, the pilot pump 15 may be omitted. In this case, the function performed by the pilot pump 15 may be implemented by the main pump 14. That is, the main pump 14 may be provided with a function of supplying hydraulic oil to the operation device 26 or the like after the pressure of the hydraulic oil is lowered by a diaphragm or the like, separately from the function of supplying hydraulic oil to the control valve 17.

The control valve 17 is a hydraulic control mechanism for controlling the hydraulic system in the excavator. In the present embodiment, the control valve 17 is configured as a valve block that includes control valves 171 to 176. The control valve 17 may selectively supply the hydraulic oil discharged by the main pump 14 to one or more hydraulic actuators through the control valves 171 to 176. The control valves 171 to 176 control the flow rate of hydraulic oil flowing from the main pump 14 to the hydraulic actuator and the flow rate of hydraulic oil flowing from the hydraulic actuator to the hydraulic oil tank. The hydraulic actuator includes the boom cylinder 7, the arm cylinder 8, the bucket cylinder 9, a left-side traveling hydraulic motor 1L, a right-side traveling hydraulic motor 1R, and a turning hydraulic motor 2A. The turning hydraulic motor 2A may be replaced by a turning motor generator as an electric actuator.

The control valve 171 corresponds to the turning hydraulic motor 2A, the control valve 172 corresponds to the right-side traveling hydraulic motor 1R, and the control valve 173 corresponds to the left-side traveling hydraulic motor 1L. The control valve 174 corresponds to the bucket cylinder 9, the control valve 175 corresponds to the arm cylinder 8, and the control valve 176 corresponds to the boom cylinder 7.

The operation device 26 is a device used by an operator for operating the actuator. The actuator includes at least one of a hydraulic actuator or an electric actuator. In the present embodiment, the operation device 26 supplies the hydraulic oil discharged by the pilot pump 15 via a pilot line to the pilot port of the corresponding control valve in the control valve 17. The pressure (pilot pressure) of the hydraulic oil supplied to each of the pilot ports is the pressure corresponding to the direction and amount of operation with respect to the operation device 26 corresponding to each of the hydraulic actuators. The operation device 26 is configured to supply hydraulic oil discharged by the pilot pump 15 to the pilot port of a corresponding control valve within the control valve 17 via a pilot line.

The discharge pressure sensor 28 is configured to detect the discharge pressure of the main pump 14. In the present embodiment, the discharge pressure sensor 28 outputs the detected value to the controller 30.

The operation pressure sensor 29 is configured to detect the content of the operator's operation performed by using the operation device 26. In the present embodiment, the operation pressure sensor 29 detects, in the form of pressure, the direction and amount of operation with respect to the operation device 26 corresponding to each of the actuators, and outputs the detected value to the controller 30. The operation content with respect to the operation device 26 may be detected by using other sensors other than the operation pressure sensor.

The controller 30 includes a state determining unit 35 and a vibration intensity determining unit 36 as functional elements. In the present embodiment, each functional element is implemented by software, but may be implemented by hardware or by a combination of hardware and software.

The state determining unit 35 is configured to determine an operation state of the excavator 100. According to the present embodiment, the state determining unit 35 determines whether the present operation state of the excavator 100 is a stopped state, a working state, or a traveling state based on the information acquired by an information acquiring apparatus. The information acquired by the information acquiring apparatus includes at least one of a boom angle, an arm angle, a bucket angle, an forward-backward tilt angle (pitch angle), a left-right tilt angle (roll angle), a turning angular velocity, a turning angle, an image captured by the imaging device S6, the boom rod pressure, the boom bottom pressure, the arm rod pressure, the arm bottom pressure, the bucket rod pressure, the bucket bottom pressure, the discharge pressure of the main pump 14, the operation pressure relating to the operation device 26, or the like. The information acquiring apparatus includes at least one of the boom angle sensor S1, the arm angle sensor S2, the bucket angle sensor S3, the inertial sensor S4, the imaging device S6, the boom rod pressure sensor S7R, the boom bottom pressure sensor S7B, the arm rod pressure sensor S8R, the arm bottom pressure sensor S8B, the bucket rod pressure sensor S9R, the bucket bottom pressure sensor S9B, the discharge pressure sensor 28, the operation pressure sensor 29, or the like.

A stopped state means a state in which the engine 11 is in operation and in which neither a traveling actuator nor a work actuator is in operation. In the present embodiment, the traveling actuator is the left-side traveling hydraulic motor 1L and the right-side traveling hydraulic motor 1R. The work actuator is the boom cylinder 7, the arm cylinder 8, the bucket cylinder 9, and the turning hydraulic motor 2A. The work actuator may include a hydraulic actuator for operating a grapple, a breaker, a lifting magnet, or the like. A working state means a state where the traveling actuator is not in operation and the work actuator is in operation. The traveling state means the state in which the traveling actuator is in operation. The traveling state includes a state in which the traveling actuator is in operation and the work actuator is in operation, and a state in which the traveling actuator is in operation and the work actuator is not in operation.

The state determining unit 35 determines that the present operation state of the excavator 100 is a stopped state, for example, when the state determining unit 35 detects that neither the traveling actuator nor the work actuator is in operation based on, for example, the output of the operation pressure sensor 29 (for example, the lever input state). Specifically, the state determining unit 35 determines that the right-side traveling hydraulic motor 1R is in operation when the operation pressure acting on the pilot port of the control valve 172 corresponding to the right-side traveling hydraulic motor 1R is greater than or equal to predetermined pressure, and determines that the right-side traveling hydraulic motor 1R is not in operation when the operation pressure is less than the predetermined pressure. The same applies to other hydraulic actuators.

The state determining unit 35 detects that the work actuator is in operation, for example, based on the output of the operation pressure sensor 29, and determines that the present operation state of the excavator 100 is the working state when the state determining unit 35 detects that the traveling actuator is not in operation.

Further, the state determining unit 35 determines that the present operation state of the excavator 100 is the traveling state when the state determining unit 35 detects that the traveling actuator is in operation, for example, based on the output of the operation pressure sensor 29.

The vibration intensity determining unit 36 is configured to determine the magnitude of vibration at each predetermined timing. The vibration intensity determining unit 36 is configured to determine, for example, the magnitude of the vibration at each predetermined timing from the moment when the engine 11 is started. In the present embodiment, the vibration intensity determining unit 36 is configured to determine the magnitude of vibration in the stopped state every time the cumulative time of the stopped state reaches a predetermined first set time, and is configured to determine the magnitude of vibration in the working state every time the cumulative time of the working state reaches a predetermined second set time, and is configured to determine the magnitude of vibration in the traveling state every time the cumulative time of the traveling state reaches a predetermined third set time. The first set time, the second set time, and the third set time are of the same period of time in the present embodiment (e.g., approximately a few minutes), but these times may be different periods of time. The first set time, the second set time, and the third set time may be approximately several seconds, approximately several tens of minutes, or approximately several hours.

The cumulative time count of the stopped state is reset each time the first set time is reached, but is interrupted without being reset when the stopped state is switched to another operation state. The cumulative time count of the stopped state is restarted when the stopped state is restarted. The same applies to the cumulative time count of the working state and the cumulative time count of the traveling state.

The vibration intensity determining unit 36 is configured to calculate the magnitude of vibration based on the output of the inertial sensor S4. In the present embodiment, the vibration intensity determining unit 36 calculates the vibration intensity VL1, which is the magnitude of the vibration in the current stopped state, based on the output of the inertial sensor S4 acquired for each predetermined control cycle (for example, several tens of milliseconds) during the period from the start of the stopped state to when the cumulative time of the stopped state reaches the first set time T1, and the following formula (1). The period from the start of the stopped state until the cumulative time of the stopped state reaches the first set time T1 excludes the period during which the count of the cumulative time of the stopped state is interrupted. The denotations of x1, y1, and z1 are the accelerations in the forward-backward axis direction, the left-right axis direction, and the up-down axis direction respectively of the upper turning body 3, which are acquired for each predetermined control cycle in the current stopped state. The vibration intensity determining unit 36 does not necessarily need to calculate the magnitude of vibration based on the output of the inertial sensor S4, but may calculate the magnitude of vibration based on the output of at least one of the boom angle sensor S1, the arm angle sensor S2, the bucket angle sensor S3, and the like, other than the inertial sensor S4. Further, the attachment is not vigorously operated while the excavator 100 is traveling, and, therefore, the vibration intensity determining unit 36 can calculate the magnitude of vibration by using the output of at least one the boom angle sensor S1, the arm angle sensor S2, and the bucket angle sensor S3 attached to the attachment.

[Formula 1]

$$VL1 = \sqrt{\frac{1}{T1}\left(\sum_{0}^{T1} x1^2 + \sum_{0}^{T1} y1^2 + \sum_{0}^{T1} z1^2\right)} \quad (1)$$

The vibration intensity determining unit 36 calculates the vibration intensity VL2, i.e., the magnitude of the vibration in the current working state, based on the output of the inertial sensor S4 acquired for each predetermined control cycle during the period from the start of the working state until the cumulative time of the working state reaches the second set time T2, and the following formula (2). Note that the period from the start of the working state until the cumulative time of the working state reaches the second set time T2 excludes the period during which the count of the cumulative time of the working state is interrupted. The denotations of x2, y2, and z2 are the accelerations in the forward-backward axis direction, the left-right axis direction, and the up-down axis direction of the of the upper turning body 3, which are acquired for each predetermined control cycle in the current working state.

[Formula 2]

$$VL2 = \sqrt{\frac{1}{T2}\left(\sum_{0}^{T2} x2^2 + \sum_{0}^{T2} y2^2 + \sum_{0}^{T2} z2^2\right)} \quad (2)$$

Similarly, the vibration intensity determining unit 36 calculates the vibration intensity VL3, which is the magnitude of the vibration in the current traveling state, based on the output of the inertial sensor S4 acquired for each predetermined control cycle during the period from the start of the traveling state to when the cumulative time of traveling state the reaches the third set time T3, and the following formula (3). The period from the start of the traveling state until the cumulative time of the traveling state reaches the third set time T3 excludes the period during which the count of the cumulative time of traveling state is interrupted. The denotations of x3, y3, and z3 are the accelerations in the forward-backward axis direction, the left-right axis direction, and the up-down axis direction respectively of the upper turning body 3 acquired for each predetermined control cycle in the current traveling state.

[Formula 3]

$$VL3 = \sqrt{\frac{1}{T3}\left(\sum_{0}^{T3} x3^2 + \sum_{0}^{T3} y3^2 + \sum_{0}^{T3} z3^2\right)} \quad (3)$$

The vibration intensity determining unit 36 is configured to transmit the calculated vibration intensity to the outside. In the present embodiment, the vibration intensity determining unit 36 is configured to transmit information relating to the vibration including the calculated vibration intensity to the server 22 through the communication device 48.

The server 22 that has received the information relating to vibration is configured to classify the vibration intensities into a plurality of levels. In the present embodiment, the server 22 is configured to classify each of the vibration intensities VL1, VL2, and VL3 into a level among nine levels.

For example, the server 22 determines that the vibration intensity VL1 in the stopped state is at the first level (the minimum level) when the vibration intensity VL1 is greater than or equal to the first threshold TL1 and less than the second threshold TL2 (>TL1), and determines that the vibration intensity VL1 is at the second level when the vibration intensity VL1 is greater than or equal to the second threshold TL2 and less than the third threshold TL3 (>TL2). The same applies to the third level to the ninth level (maximum level). The number of levels of the vibration intensity (hereinafter referred to as "vibration intensity levels") may be 8 or less and may be 10 or more.

The threshold values for each vibration intensity level, such as the first threshold TL1 to the ninth threshold TL9, may be fixed values stored in advance and may be dynamically adjusted. For example, the server 22 may adjust each of the thresholds set for each vibration intensity level based on the posture of the attachment. The posture of the attachment is derived based on the output of a posture sensor. In this case, the vibration intensity determining unit 36 may transmit, to the server 22, as information relating to the vibration, the vibration intensity as well as the output of the posture sensor or information relating to the posture of the attachment derived based on the output of the posture sensor.

Further, the server 22 is configured to count the number of times that the magnitude of the vibration is determined (the determination count) with respect to each vibration intensity level. In the present embodiment, the server 22 is configured to count the determination count for each of the nine vibration intensity levels.

The vibration intensity determining unit 36 may be configured to classify the vibration intensities into a plurality of levels and may be configured to count the determination count for each vibration intensity level. In this case, the vibration intensity determining unit 36 may transmit the classification result or the count result as information relating to the vibration, to the server 22.

Figure 3:
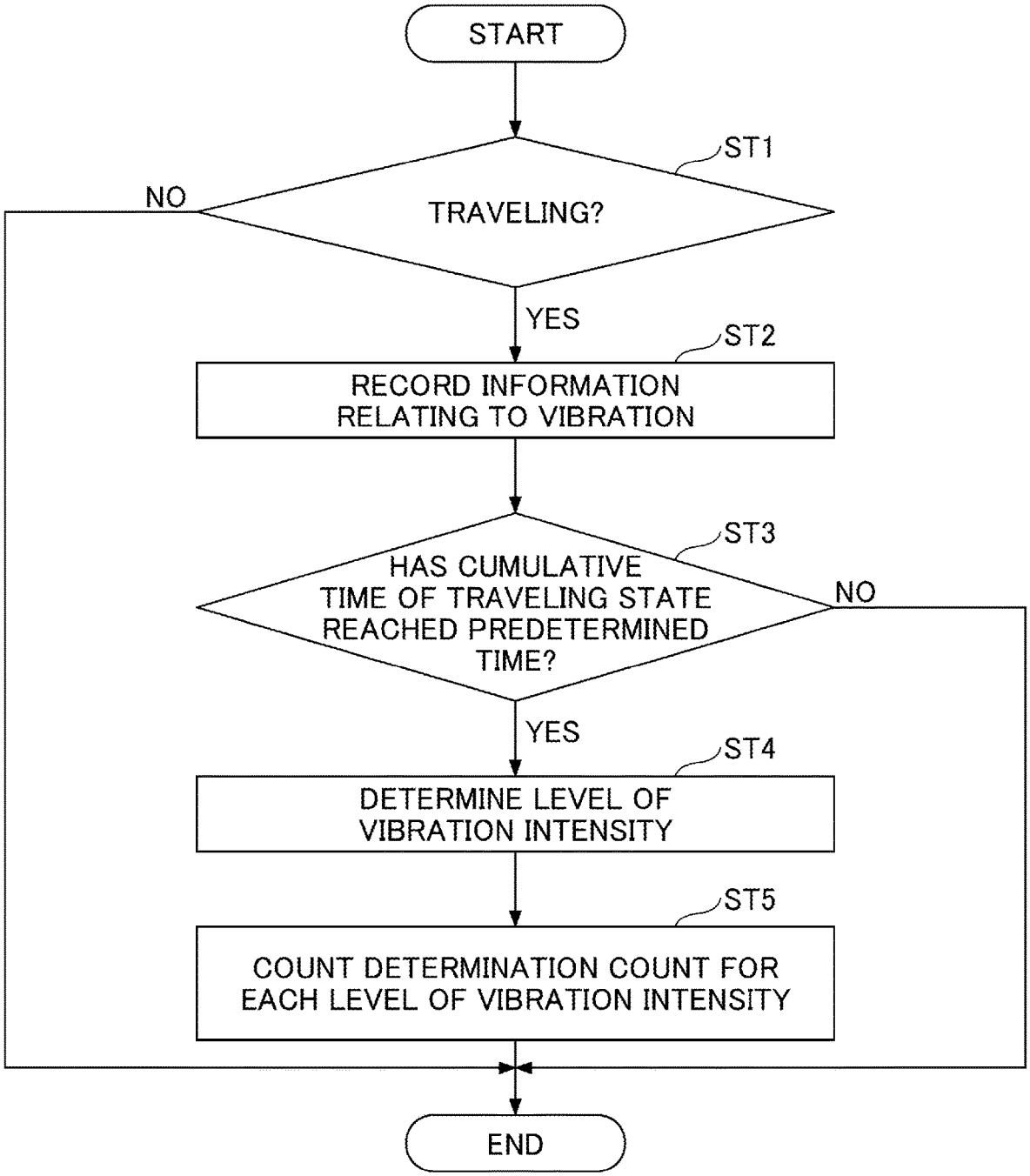
FIG. 3 is a flowchart of the traveling vibration intensity determination process.

Next, an example of a process for determining, by the controller 30, the vibration intensity during traveling (hereinafter referred to as "traveling vibration intensity determination process"), will be described with reference to FIG. 3. FIG. 3 is a flowchart illustrating an example of a traveling vibration intensity determination process. In the present embodiment, the controller 30 repeatedly performs the traveling vibration intensity determination process at a predetermined control cycle. The following description of the traveling vibration intensity determination process is likewise applied to a working vibration intensity determination process, which is a process for determining, by the controller 30, the vibration intensity during the working state, or a stopped vibration intensity determination process, which is a process for determining, by the controller 30, the vibration intensity during the stopped state.

Initially, the controller 30 determines whether the excavator 100 is traveling (step ST1). In the present embodiment, the state determining unit 35 of the controller 30 determines that the excavator 100 is traveling if a traveling operation is being performed. Specifically, the controller 30 determines whether the traveling lever is operated based on the output of the operation pressure sensor 29. If it is determined that the driving lever is being operated, the controller 30 determines that the excavator 100 is traveling, and if it is determined that the driving lever is not being operated, the controller 30 determines that the excavator 100 is not traveling.

If it is determined that the excavator 100 is not traveling (NO in step ST1), the controller 30 ends the current traveling vibration intensity determination process.

If it is determined that the excavator 100 is traveling (YES in step ST1), the controller 30 records the information relating to vibration (step ST2). The information relating to vibration may be recorded by being stored (written) in a volatile storage device or by being stored (written) in a non-volatile storage device. In the case of storage in a volatile storage, the information relating to vibration is stored such that the information relating to vibration is not erased or overwritten for at least a predetermined period of time. In the present embodiment, the vibration intensity determining unit 36 in the controller 30 synchronously records, in time series, the outputs from at least two of the posture sensor, the cylinder pressure sensor, the discharge pressure sensor 28, and the like. However, the controller 30 may be configured to continuously record the outputs from at least one of the posture sensor, the cylinder pressure sensor, the discharge pressure sensor 28, and the like, regardless of whether the excavator 100 is traveling or not. In this case, the controller 30 may be configured to distinguish between data recorded during a traveling state and data recorded during a non-traveling state.

Thereafter, the controller 30 determines whether the cumulative time of the traveling state has reached a predetermined time (step ST3). In the present embodiment, the vibration intensity determining unit 36 determines whether the cumulative time of the traveling state that continues or intermittently continues has reached the third set time T3.

If it is determined that the cumulative time of the traveling state has not reached the predetermined time (NO in the step ST3), the controller 30 ends the current traveling vibration intensity determination process.

If it is determined that the cumulative time of the traveling state has reached a predetermined time (YES in step ST3), the controller 30 determines the level of vibration intensity (step ST4). In the present embodiment, the vibration intensity determining unit 36 uses formula (3) to derive the vibration intensity VL3 during the period in which the cumulative time of the traveling state has been counted. If the vibration intensity VL3 is greater than or equal to the first threshold TL1 and is less than the second threshold TL2, it is determined that the vibration intensity VL3 is at the first level, and if the vibration intensity VL3 is greater than or equal to the second threshold TL2 and is less than the third threshold TL3, it is determined that the vibration intensity VL3 is at the second level. The same applies to the third level to the ninth level. In the present embodiment, if it is determined that the cumulative time of the traveling state reaches the third set time T3, the vibration intensity determining unit 36 resets the cumulative time of the traveling state and transmits, to the server 22, information relating to the vibration including the determination result of the level of the vibration intensity. However, the vibration intensity determining unit 36 may transmit information relating to vibration including the vibration intensity VL3 to the server 22, rather than the determination result of the level of vibration intensity. In this case, the server 22 may determine the level of vibration intensity based on the received vibration intensity VL3. Alternatively, the vibration intensity determining unit 36 may transmit, to the server 22, information relating to vibration including the data recorded during the traveling state that is used to calculate the vibration intensity VL3, rather than transmitting the determination result of the level of vibration intensity or the vibration intensity VL3. In this case, the server 22 may calculate the vibration intensity VL3 based on the received data, and further determine the level of vibration intensity based on the vibration intensity VL3.

At this time, the server 22 may also acquire, at the same time, at least one of the setting information or the work environment information and store the acquired information together with the vibration intensity. Setting information includes information relating to the traveling mode (e.g., whether a low speed high torque mode or a high speed low torque mode has been selected, etc.) and information relating to the engine setting mode (e.g., information relating to the set revolution speed or the set horsepower, etc.). The work environment information may include work information, weather information, traveling surface information, or the like, and this information may be acquired, for example, by the imaging device S6. The traveling surface information includes the degree of irregularities on the traveling surface or the type of traveling surface. The type of traveling surface may be, for example, "clay", "silt", "sand", "pebbles (gravel)", "coarse stones", "concrete", "iron plate", or "asphalt". The type of the traveling surface may be determined based on the position information of the excavator 100, by using geographical information registered in an external server or the like.

Thereafter, the server 22 counts the determination count for each level of vibration intensity (step ST5). In the present embodiment, the server 22 updates the vibration intensity table stored in the non-volatile storage device in the server 22. However, the determination count may be counted by the controller 30. In this case, the vibration intensity table may be stored in non-volatile storage device in the controller 30. At this point, the vibration intensity determining unit 36 may transmit the result of the counting of the determination count to the server 22 as information relating to vibration.

The vibration intensity table is a look-up table for managing the determination count for each level of vibration intensity. The vibration intensity table includes an electronic counter that stores the determination count for each level of vibration intensity. For example, if it is determined that the vibration intensity in the current traveling state is the first level, the vibration intensity determining unit 36 increments the electronic counter with respect to the first level by one, and if it is determined that the vibration intensity in the current traveling state is the second level, the vibration intensity determining unit 36 increments the electronic counter with respect to the second level by one. The same applies to other levels of vibration intensity.

Figure 4:
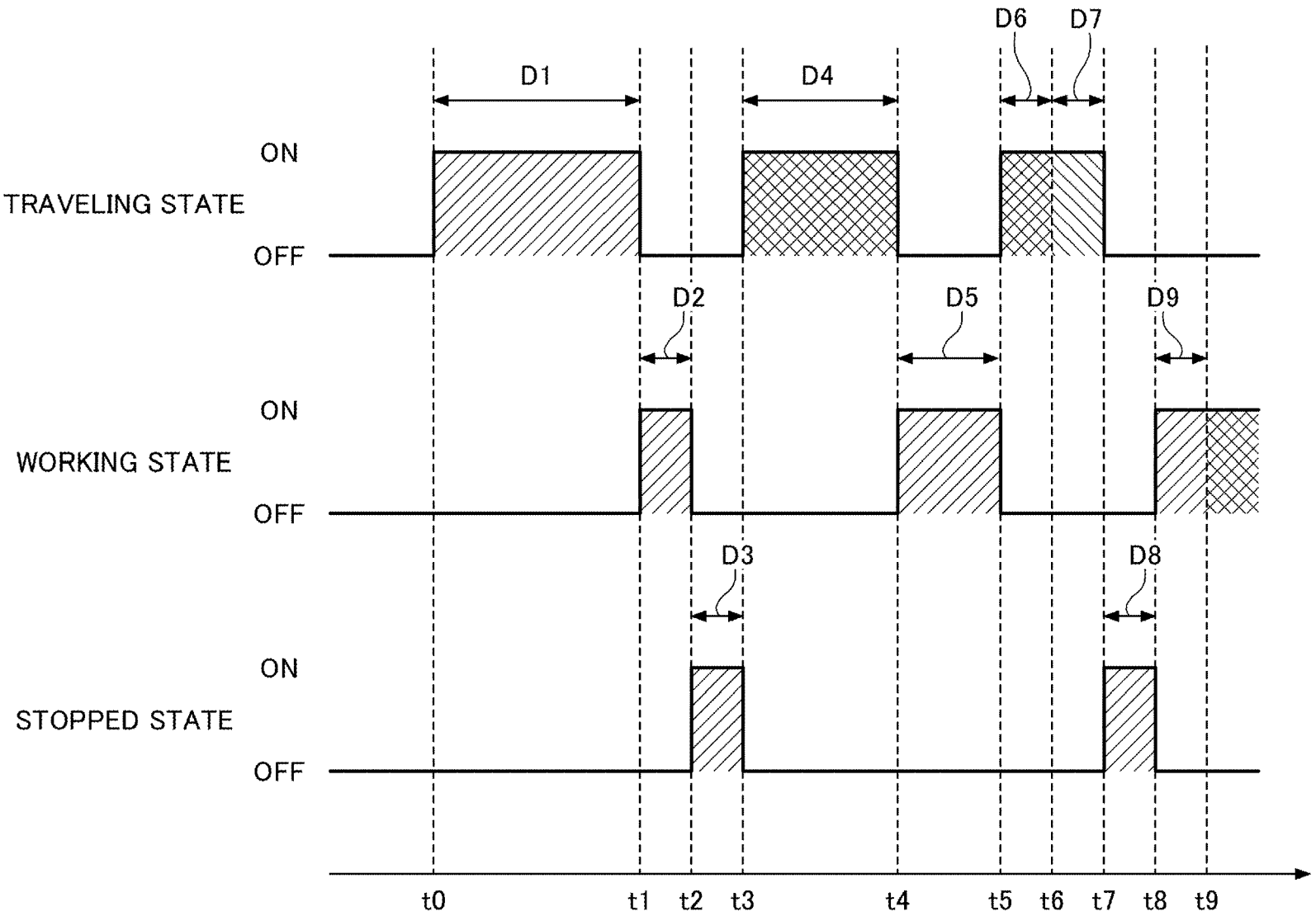
FIG. 4 is a diagram illustrating the timewise transition of the operation state of the excavator.

Referring now to FIG. 4, the relationship between the cumulative time of each of the three operation states (stopped state, working state, and traveling state) of the excavator 100 and the timing of transmitting the information relating to the vibration will be described. FIG. 4 illustrates the timewise transition of ON/OFF of each of the three operation states of the excavator 100. In FIG. 4, the vertical axis corresponds to ON/OFF of each operation state, and the horizontal axis corresponds to time. When the traveling state is ON, it means that the operation state of the excavator 100 is the traveling state, when the working state is ON, it means that the operation state of the excavator 100 is the working state, and when the stopped state is ON, it means that the operation state of the excavator 100 is the stopped state. In FIG. 4, the diagonal hatching and the cross hatching each represent a block at each predetermined set time.

As illustrated in FIG. 4, when the traveling lever is operated at time t0, the controller 30 determines that the operation state of the excavator 100 is the traveling state and starts counting the cumulative time of the traveling state. The controller 30 records the output of the inertial sensor S4 in a non-volatile storage device as information relating to vibration during the traveling.

When the cumulative time D1 of the traveling state reaches the third set time T3 at time t1, the controller 30 calculates the vibration intensity VL3 based on the output of the inertial sensor S4 acquired repeatedly between time t0 and time t1. The controller 30 transmits information relating to vibration including the calculated vibration intensity VL3 to the server 22 as information relating to vibration during the traveling.

When the operation of the traveling lever is stopped and the boom operation lever is operated at time t1, the controller 30 determines that the operation state of the excavator 100 has switched from the traveling state to the working state, stops counting the cumulative time of the traveling state, and starts counting the cumulative time of the working state. At this time, the controller 30 resets the cumulative time of the traveling state to zero. The controller 30 records the output of the inertial sensor S4 in a non-volatile storage device as information relating to vibration during working.

Thereafter, when the operation of the boom operation lever is stopped at time t2, the controller 30 determines that the operation state of the excavator 100 has switched from the working state to the stopped state, stops counting the cumulative time of the working state, and starts counting the cumulative time of the stopped state. At this time, the controller 30 does not calculate the vibration intensity VL2 during the working and does not reset the cumulative time D2 of the working state to zero. This is because the cumulative time D2 of the working state has not reached the second set time T2. Thereafter, the controller 30 records the output of the inertial sensor S4 in a non-volatile storage device as information relating to vibration during the stopped state.

Thereafter, when the traveling lever is operated at time t3, the controller 30 determines that the operation state of the excavator 100 has switched from the stopped state to the traveling state, stops counting the cumulative time of the stopped state, and starts counting the cumulative time of the traveling state. At this time, the controller 30 does not calculate the vibration intensity VL1 during the stopped state and does not reset the cumulative time D3 of the stopped state to zero. This is because the cumulative time D3 of the stopped state has not reached the first set time T1. Thereafter, the controller 30 records the output of the inertial sensor S4 in a non-volatile storage device as information relating to vibration during traveling.

Thereafter, when the operation of the traveling lever is stopped and the boom operating lever is operated at time t4, the controller 30 determines that the operation state of the excavator 100 has switched from the traveling state to the working state, stops counting the cumulative time of the traveling state, and restarts counting the cumulative time of the working state. At this time, the controller 30 does not calculate the vibration intensity VL3 during traveling and does not reset the cumulative time D4 of the traveling state to zero. This is because the cumulative time D4 of the traveling state has not reached the third set time T3. The controller 30 then records the output of the inertial sensor S4 in a non-volatile storage device as information relating to vibration during the working.

Thereafter, when the operation of the boom operation lever is stopped and the traveling lever is operated at time t5, the controller 30 determines that the operation state of the excavator 100 has been switched from the working state to the traveling state, stops counting the cumulative time of the working state, and restarts counting the cumulative time of the traveling state. At this time, the controller 30 does not calculate the vibration intensity VL2 during the working and does not reset the cumulative time (D2+D5) of the working state to zero. This is because the cumulative time (D2+D5) of the working state has not reached the second set time T2. Thereafter, the controller 30 records the output of the inertial sensor S4 in a non-volatile storage device as information relating to vibration during the traveling.

Thereafter, when the cumulative time (D4+D6) of the traveling state reaches the third set time T3 at time t6, the controller 30 calculates the vibration intensity VL3 based on the output of the inertial sensor S4 acquired repeatedly between time t3 and time t4 and between time t5 and time t6. The controller 30 transmits information relating to vibration including the calculated vibration intensity VL3 to the server 22 as information relating to vibration during traveling.

The controller 30 restarts counting the cumulative time of the traveling state at time t6, after resetting the cumulative time (D4+D6) of the traveling state to zero. The controller 30 subsequently records the output of the inertial sensor S4 in the non-volatile storage device as information relating to vibration during traveling.

Thereafter, when the operation of the traveling lever is stopped at time t7, the controller 30 determines that the operation state of the excavator 100 has switched from the traveling state to the stopped state, stops counting the cumulative time of the traveling state, and starts counting the cumulative time of the stopped state. At this time, the controller 30 does not calculate the vibration intensity VL3 during traveling and does not reset the cumulative time D7 of the traveling state to zero. This is because the cumulative time D7 of the traveling state has not reached the third set time T3. Thereafter, the controller 30 records the output of the inertial sensor S4 in a non-volatile storage device as information relating to vibration during the stopped state.

Thereafter, when the boom operation lever is operated at time t8, the controller 30 determines that the operation state of the excavator 100 has switched from the stopped state to the working state, stops counting the cumulative time of the stopped state, and restarts counting the cumulative time of the working state. At this time, the controller 30 does not calculate the vibration intensity VL1 during the stopped state, and does not reset the cumulative time (D3+D8) of the stopped state to zero. This is because the cumulative time of the stopped state (D3+D8) has not reached the first set time T1. The controller 30 then records the output of the inertial sensor S4 in a non-volatile storage device as information relating to vibration during working.

Thereafter, when the cumulative time (D2+D5+D9) of the working state reaches the second set time T2 at time t9, the controller 30 calculates the vibration intensity VL2 based on the output of the inertial sensor S4 acquired repeatedly between time t1 and time t2, between time t4 and time t5, and between time t8 and time t9. The controller 30 transmits information relating to vibration including the calculated vibration intensity VL2 to the server 22 as information relating to vibration during the working.

As described above, the controller 30 calculates the vibration intensity VL3 every time the controller 30 collects information relating to vibration during traveling for the third set time T3 and transmits the information relating to vibration during traveling including the calculated vibration intensity VL3 to the server 22. The controller 30 calculates the vibration intensity VL2 every time the controller 30 collects information relating to the vibration during the working for the second set time T2 and transmits information relating to the vibration during the working including the calculated vibration intensity VL2 to the server 22. Similarly, the controller 30 calculates the vibration intensity VL1 every time the controller 30 collects information relating to vibration during the stopped state for the first set time T1 and transmits information relating to vibration during the stopped state including the calculated vibration intensity VL1 to the server 22.

With this configuration, the controller 30 can transmit information relating to vibration to the server 22 at an appropriate timing while controlling the communication amount. However, the controller 30 may continuously, i.e., in real time, transmit information relating to vibration to the server 22.

Next, a breakdown of the operation states of the excavator 100 that differ from one work site to another will be described with reference to FIG. 5. FIG. 5 is a table illustrating the breakdown of past operation states of the excavator 100.

FIG. 5 illustrates that in the work site A, the total cumulative time of the traveling state was 0.2 hours, the total cumulative time of the stopped state was 0.3 hours, and the total cumulative time of the working state was 0.5 hours, and in the work site B, the total cumulative time of the traveling state was 0.1 hours, the total cumulative time of the stopped state was 0.5 hours, and the total cumulative time of the working state was 0.6 hours. The total cumulative time of the traveling state is, for example, the sum of each cumulative time reset each time the third set time T3 is reached. The same applies to the total cumulative time of working state and the total cumulative time of stopped state.

The server 22 may include a display device for displaying a table as illustrated in FIG. 5 based on information relating to vibration transmitted from the excavator 100. In this case, information relating to vibration may include information for identifying a work site, such as the location information of the excavator 100. The total cumulative time of the traveling state may be calculated based on the number of times the server 22 has received information relating to vibration during traveling. For example, the total cumulative time of the traveling state may be the time obtained by multiplying the number of times that the operation state is determined to be the traveling state, by the third set time T3. The same applies to the total cumulative time of stopped state and the total cumulative time of working state.

The manager of the excavator who has looked at the table illustrated in FIG. 5 can identify, for example, a trend in which the total cumulative time of the traveling state of an excavator used at a civil engineering work site is longer than the total cumulative time of the traveling state of an excavator used at a stone crushing work site or a recycling work site, or a trend in which the total cumulative time of the working state at a particular work site is longer than the total cumulative time of each of the other operation states at the particular work site.

Next, a vibration intensity table will be described with reference to FIGS. 6A to 6C. FIGS. 6A to 6C are conceptual diagrams of vibration intensity tables. Specifically, FIG. 6A illustrates the state of the vibration intensity table at a time point prior to time t0 in FIG. 4, i.e., the initial state of the vibration intensity table. FIG. 6B illustrates the state of the vibration intensity table immediately after the time t1 of FIG. 4, i.e., immediately after determining that the vibration intensity VL3 during traveling is the first level. FIG. 6C illustrates the state of the vibration intensity table immediately after the time t6 in FIG. 4, i.e., immediately after determining that the vibration intensity VL3 during traveling is the second level. In the example illustrated in FIGS. 4, 6A, 6B, and 6C, the controller 30 transmits information relating to vibration including the determination result to the server 22, each time the level of the vibration intensity VL3 is determined. Therefore, when the vibration intensity VL3 is classified into the fourth level at time t1, the server 22 refers to the vibration intensity table stored in the non-volatile storage device of the server 22 and increments the electronic counter with respect to the fourth level by one. When the vibration intensity VL3 is classified as the eighth level at time t6, the controller 30 refers to the vibration intensity table stored in the non-volatile storage device of the server 22 and increments the electronic counter with respect to the eighth level by one.

However, the controller 30 may transmit the information stored in the vibration intensity table in the non-volatile storage device of the controller 30 to the outside when a predetermined condition is satisfied. The predetermined condition includes, for example, when a predetermined time is reached, when a predetermined time elapses after starting to count the determination count, when the determination count exceeds a predetermined number, when a predetermined operation is performed, or the like. The predetermined operation may include, for example, pressing a predetermined button, turning the engine switch off, or the like. The controller 30 may also reset the electronic counter of the vibration intensity table after the information stored in the vibration intensity table has been transmitted to the outside.

Figure 7:
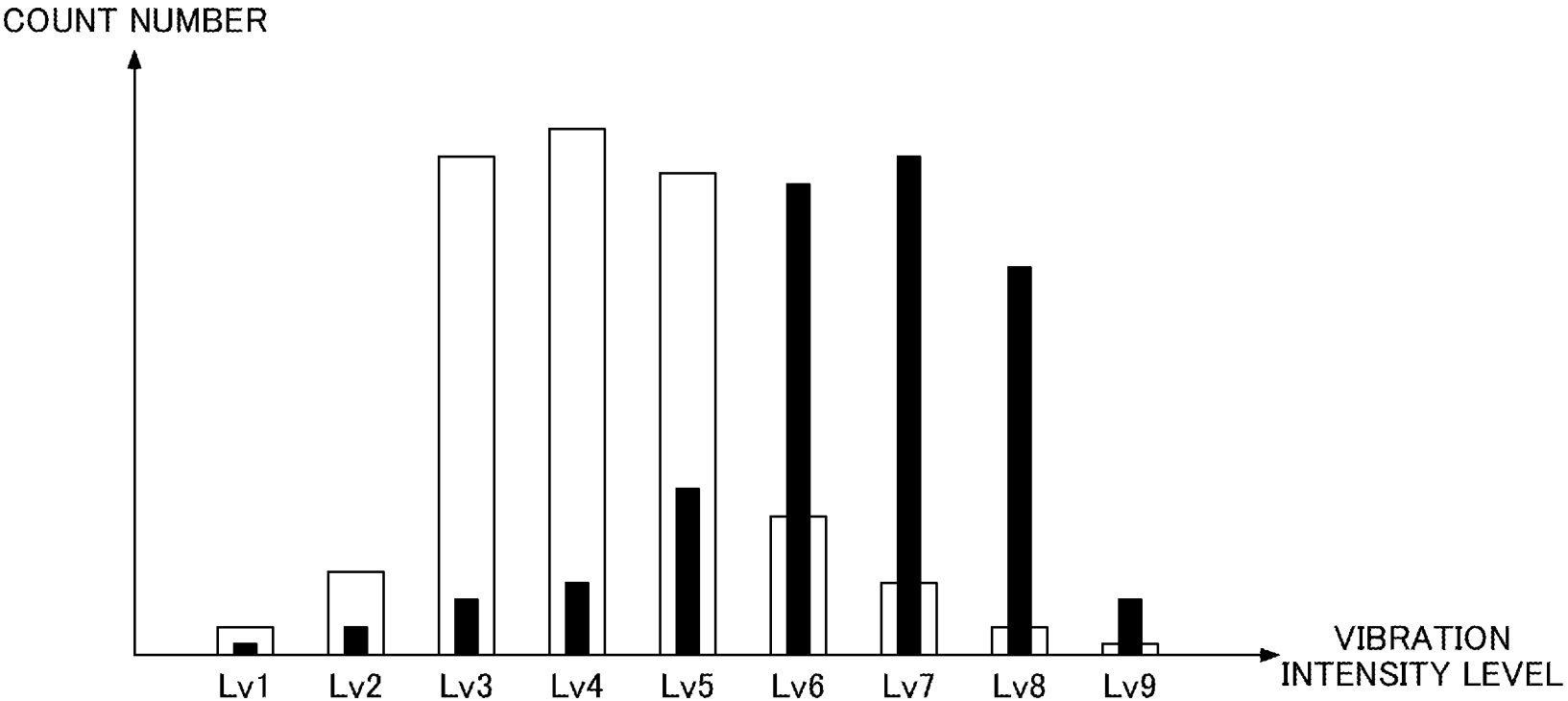
FIG. 7 is a diagram illustrating an example of display of information relating to vibration.

Next, a display example of information relating to vibration will be described with reference to FIG. 7. FIG. 7 illustrates an example of information relating to vibration displayed on the display attached to the server 22.

In the present embodiment, at a predetermined time, the controller 30 transmits the information stored in the vibration intensity table to the server 22 as information relating to vibration. The server 22 that has received the information relating to the vibration stores the information relating to the vibration in a predetermined storage area so that the information relating to the vibration can be viewed on a display attached to the server 22 or the communication terminal 23. As a result, the manager can view the information relating to vibration on the display attached to the server 22 or the communication terminal 23.

Specifically, FIG. 7 is a histogram illustrating the frequency for each vibration intensity level of two excavators 100 for which the determination of vibration intensity during traveling is made by the same number of times (e.g., several hundred times). The horizontal axis corresponds to the nine vibration intensity levels. The notation of "Lv1" on the horizontal axis means the first level. The same applies to "Lv2", "Lv3", . . . , "Lv9". The vertical axis corresponds to the determination count for each vibration intensity level. White bars refer to a first excavator used at a civil engineering work site, and black bars refer to a second excavator used at a stone crushing work site.

As illustrated in FIG. 7, in the first excavator, the vibration intensity level is determined to be from the third level to the fifth level relatively many times, and is most frequently determined to be at the fourth level. On the other hand, in the second excavator, the vibration intensity level is determined to be from the sixth level to the eighth level relatively many times, and is most frequently determined to be at the seventh level. The manager who views the information relating to vibration illustrated in FIG. 7 can recognize that the degree of wear of the second excavator used in the stone crushing work site is higher than the degree of wear of the first excavator used in the civil engineering work site. The manager is also better able to determine the amortization period of excavators. The ground-contact area of the crawler shoe at a stone crushing work site is typically smaller than the ground-contact area of the crawler shoe at a civil engineering work site. This is because the crawler shoe comes into contact with relatively large stones compared to soil at a civil engineering work site. The degree of wear of the excavator 100 may also include, for example, the degree of wear of the cabin 10, the degree of wear of the crawler shoe or the idler roller, or loosening of a bolt or screw as a fastener member.

Thus, by viewing information relating to vibration on the display, the manager can more accurately identify the degree of wear of the excavator. Thus, the manager can set an appropriate maintenance menu according to the degree of wear of the excavator 100, even if the manager is at a location far away from the work site. Also, the manager can more accurately identify the degree of wear of the excavator 100, compared to the case of identifying the degree of wear of the excavator 100 based on the load on the attachment or the engine that is calculated by using an hour meter, thereby ensuring long-term and stable operations of the excavator 100. Further, by using the information relating to vibration as illustrated in FIG. 7, the manager can quantitatively determine the degree of wear of the excavator 100 without depending on individual skills.

As described above, the excavator 100 according to an embodiment of the present invention includes the lower traveling body 1 and the controller 30 as a control apparatus configured to determine the traveling vibration at each predetermined timing. With this configuration, the excavator 100 allows the manager of the excavator 100 to more accurately identify the degree of wear of the excavator 100.

The controller 30 is preferably configured to classify the magnitude of the traveling vibration, which is vibration during traveling, into a plurality of levels and to count the determination count with respect to each level. With this configuration, the manager of the excavator 100 can identify in more detail how a particular excavator 100 has been used.

The magnitude of the traveling vibration is preferably calculated based on the output of the inertial sensor S4 attached to the upper turning body 3. However, the controller 30 may be configured to calculate the traveling vibration based on the output of the inertial sensor attached to the lower traveling body 1. Alternatively, the controller 30 may calculate the magnitude of the traveling vibration based on changes in the surrounding image acquired by an image sensor attached to at least one of the lower traveling body 1 or the upper turning body 3, and may calculate the magnitude of the traveling vibration based on the output of, for example, a tilt sensor or a vibration sensor attached to at least one of the lower traveling body 1 or the upper turning body 3. Alternatively, the controller 30 may calculate the magnitude of the traveling vibration based on the output of a fuel remaining amount sensor (the value representing the vertical movement of a float floating on the liquid surface of the fuel in the fuel tank). That is, the controller 30 may be configured to calculate the magnitude of the traveling vibration based on the output of another sensor other than the inertial sensor, attached to at least one of the lower traveling body 1 or the upper turning body 3. With this configuration, the excavator 100 can easily derive the magnitude of the traveling vibration, for example, by using an existing sensor.

The controller 30 may calculate the work environment information of high proportion for each vibration intensity level and display the result simultaneously. The work environment information of high proportion is, for example, information relating to the type of traveling surface of a high proportion. Specifically, when the determination count of a particular vibration intensity level is 10 times, and among these, the type of traveling surface is "clay" for 6 times, the type of traveling surface is "iron plate" for 2 times, and the type of traveling surface is "concrete" for the other 2 times, then the type of traveling surface that has the highest proportion for the particular vibration intensity level is "clay". Then, regarding the first level that is the vibration intensity level, when the type of the traveling surface of the highest proportion is "clay", text information "clay" representing the type of traveling surface and the proportion thereof (for example, 60%) are displayed below the text information "Lv1" representing the vibration intensity level. Similarly, the controller 30 may calculate the setting information or work information (information relating to the type of work such as rock drilling, excavation at flat ground, excavation at height, base rock drilling, loading, ground leveling, slope leveling, dismantling, or the like) of a high proportion for each vibration intensity level, and simultaneously display the result of the calculation. Work information of a high proportion is, for example, information on the type of work of a high proportion. Specifically, when the determination count of a particular vibration intensity level is 10 times, and among these, the type of work is "excavation at height" for seven times, the type of work is "excavation at flat ground" for two times, and the type of work is "loading" for the remaining one time, then the type of work of the highest proportion for the particular vibration intensity level is "excavation at height". Then, regarding the ninth level that is the vibration intensity level, when the type of work of the highest proportion is "excavation at height", the text information "excavation at height" representing the type of work and the proportion thereof (for example, 70%) are displayed below the text information "Lv9" representing the vibration intensity level.

The server 22 that is the management apparatus of the excavator 100 according to an embodiment of the present invention is connected to the excavator 100 and is configured to store and manage the determination count counted for each level. The magnitude of the traveling vibration of the excavator 100 determined at a predetermined timing is classified into a plurality of levels. The manager of the excavator 100 can more accurately identify the degree of wear of the excavator 100 by using the information relating to the determination count that is counted for each level managed by the server 22.

The server 22 is preferably configured to display the determination count that is counted for each level. The manager of the excavator 100 may more accurately identify the degree of wear of the excavator 100, for example, by viewing information relating to the vibration displayed on the display attached to the server 22. The manager can also easily compare the degree of wear of multiple excavators by simultaneously viewing information relating to the vibration corresponding to each of the multiple excavators.

The embodiments of the present invention have been described in detail above. However, the present invention is not limited to the embodiments described above. Various modifications, substitutions and the like may be applied to the embodiments described above without departing from the scope of the present invention. Also, the features described separately may be combined unless there is a technical inconsistency.

For example, in the above described embodiment, the information relating to vibration is displayed as a histogram illustrating the frequency for each vibration intensity level for two excavators 100 for which the determination of vibration intensity during traveling is made by the same number of times (e.g., several hundred times) as illustrated in FIG. 7. However, the information relating to vibration may be displayed, for example, as a scatter diagram for a plurality of excavators for which the determination of vibration intensity is made by the same number of times. Specifically, the information relating to vibration may be displayed as a scatter diagram, in which the vibration intensity during working is represented by the horizontal axis and the vibration intensity during traveling is represented by the vertical axis. Information relating to vibration may also be displayed in other display forms, such as, for example, radar charts.

In the above described embodiment, the information relating to vibration is displayed on the display attached to the server 22 or the communication terminal 23, but the information relating to vibration may be displayed on the display apparatus 40 located in the cabin 10. The information relating to vibration may also be displayed on a display device in each of the excavator as a construction machine, the communication terminal 23 as a support apparatus, and the server 22 as a management apparatus. The information relating to vibration may be output as voice information through a speaker attached to the server 22 or the communication terminal 23.

The controller 30 may transmit information relating to vibration directly to the communication terminal 23 as a support apparatus without interposing the base station 21.

According to an aspect of the present invention, the manager of a construction machine can more accurately identify the degree of wear of the construction machine.

What is claimed is:

1. A construction machine comprising:

a lower traveling body;

an upper turning body turnably mounted on the lower traveling body; and a control apparatus configured to determine a traveling vibration of the construction machine at each predetermined timing, wherein the control apparatus is further configured to classify a magnitude of the traveling vibration into one of a plurality of levels, count a determination count indicating frequency of the traveling vibration of the construction machine with respect to each one of the plurality of levels, and calculate the magnitude of the traveling vibration based on an output from a sensor attached to the upper turning body.

2. The construction machine according to claim 1, wherein the control apparatus is configured to calculate work environment information with respect to each one of the plurality of levels.

3. The construction machine according to claim 1, wherein the control apparatus is configured to calculate work information with respect to each one of the plurality of levels.

4. The construction machine according to claim 1, wherein the control apparatus is configured to determine the traveling vibration of the construction machine at each timing when a cumulative time of a traveling state of the construction machine that continues or intermittently continues reaches a predetermined set time.

5. The construction machine according to claim 1, wherein the control apparatus is further configured to determine a vibration of the construction machine during a stopped state of the construction machine for a first set time, determine a vibration of the construction machine during working of the construction machine for a second set time, and determine the traveling vibration of the construction machine during traveling of the construction machine for a third set time.

6. A display apparatus of a construction machine, wherein the display apparatus is configured to display a determination count indicating frequency of a traveling vibration of the construction machine including a lower traveling body and an upper turning body turnably mounted on the lower traveling body, the determination count being counted with respect to each one of a plurality of levels, the traveling vibration being determined at each predetermined timing and classified into each one of the plurality of levels, and a magnitude of the traveling vibration being calculated based on an output from a sensor attached to the upper turning body.

7. The display apparatus of the construction machine according to claim 6, wherein the display apparatus is configured to display work environment information or work information relating to the traveling vibration of the construction machine including the lower traveling body, the work environment information or the work information being calculated with respect to each one of the plurality of levels, the traveling vibration being determined at each predetermined timing and classified into each one of the plurality of levels.

8. A management apparatus of a construction machine, wherein the management apparatus is configured to classify a traveling vibration of the construction machine including a lower traveling body and an upper turning body turnably mounted on the lower traveling body, into one of a plurality of levels, the traveling vibration being determined at each predetermined timing, store and manage a determination count indicating frequency of the traveling vibration, the determination count being counted with respect to each one of the plurality of levels, and calculate a magnitude of the traveling vibration based on an output from a sensor attached to the upper turning body.

9. The management apparatus of the construction machine according to claim 8, wherein the management apparatus is configured to classify the traveling vibration of the construction machine including the lower traveling body, into one of the plurality of levels, the traveling vibration being determined at each predetermined timing, and store and manage work environment information or work information that is calculated with respect to each one of the plurality of levels.

10. A construction machine comprising:

a lower traveling body;

an upper turning body turnably mounted on the lower traveling body; and a control apparatus configured to determine, at each predetermined timing, a vibration in association with a traveling operation of the construction machine, during the traveling operation of the construction machine, wherein the control apparatus is further configured to classify a magnitude of the traveling vibration into one of a plurality of levels, and count a determination count indicating frequency of the traveling vibration with respect to each one of the plurality of levels, and calculate the magnitude of the traveling vibration based on an output from a sensor attached to the upper turning body.

* * * * *